US007748319B2

(12) United States Patent
Malkic et al.

(10) Patent No.: US 7,748,319 B2
(45) Date of Patent: Jul. 6, 2010

(54) PRINTING ASSEMBLY INCLUDING A PLATE HOLDING DEVICE

(75) Inventors: Dominique Malkic, Verneuil En Halatte (FR); Dominique Deslangle, Meung sur Loire (FR)

(73) Assignee: Goss International Montataire SA, Montataire (FR)

( * ) Notice: Subject to any disclaimer, the term of this patent is extended or adjusted under 35 U.S.C. 154(b) by 0 days.

(21) Appl. No.: 11/894,937

(22) Filed: Aug. 22, 2007

(65) Prior Publication Data

US 2008/0047446 A1 Feb. 28, 2008

(30) Foreign Application Priority Data

Aug. 22, 2006 (FR) ..... 06 07456

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS

| | | | | |
|---|---|---|---|---|
| 3,095,811 | A * | 7/1963 | Peabody et al. | 101/415.1 |
| 3,757,691 | A * | 9/1973 | Etchell et al. | 101/415.1 |
| 4,347,788 | A * | 9/1982 | Dufour et al. | 101/415.1 |
| 4,802,413 | A | 2/1989 | Schroeder | |
| 5,213,038 | A * | 5/1993 | Takahashi et al. | 101/410 |
| 5,284,093 | A * | 2/1994 | Guaraldi et al. | 101/415.1 |
| 5,375,520 | A | 12/1994 | Kobler et al. | |
| 5,613,440 | A | 3/1997 | Rau | |
| 6,601,509 | B2 | 8/2003 | Noiret et al. | |
| 2002/0073862 | A1 * | 6/2002 | Noiret et al. | 101/415.1 |
| 2002/0078846 | A1 * | 6/2002 | Reichel et al. | 101/415.1 |

FOREIGN PATENT DOCUMENTS

| | | | |
|---|---|---|---|
| DE | 1178442 | B | 9/1964 |
| DE | 4225949 | A1 | 2/1994 |
| DE | 29503439 | U1 | 4/1995 |
| EP | 0252746 | A2 | 1/1988 |
| FR | 2684334 | A1 | 6/1993 |
| JP | 9066598 | | 3/1997 |

* cited by examiner

*Primary Examiner*—Leslie J Evanisko
(74) *Attorney, Agent, or Firm*—Davidson, Davidson & Kappel, LLC

(57) ABSTRACT

This printing plate (6) for a rotary press includes a head (22) for fastening to an impression cylinder, and a tail (24) for fastening to the impression cylinder.

The fastening head (22) includes a holding projection (28) suitable for mating with an element (34) for holding the impression cylinder.

13 Claims, 3 Drawing Sheets

PRINTING ASSEMBLY INCLUDING A PLATE HOLDING DEVICE

This application claims priority of French Application No. 06 07456, filed Aug. 22, 2006.

The present invention relates to a printing plate for a rotary press, of the type comprising a head for fastening to an impression cylinder, and a tail for fastening to an impression cylinder.

The invention concerns in particular rotary presses which change plates automatically.

BACKGROUND TO THE INVENTION

A printing plate suitable for being fitted on an impression cylinder is known from U.S. Pat. No. 6,601,509. The printing plate comprises a fastening head and a fastening tail suitable for being received in a fitting channel of the cylinder.

The fastening head of the plate comprises an opening in which a fastening leaf spring engages in order to hold the fastening head in the fitting channel.

The leaf spring mating with the opening is folded in two opposing directions in the shape of an S. The leaf spring engages with a ridge which is formed by its common portion and is bent into the opening.

The object of the present invention is to increase the forces holding the printing plate to the cylinder and to allow rotation of the impression cylinder at high speeds.

SUMMARY OF THE INVENTION

The present invention provides a printing plate of the aforementioned type, wherein the fastening head includes a holding projection suitable for mating with an element for holding the impression cylinder.

According to other embodiments, the printing plate according to the invention may include one or more of the following characteristics:

the holding projection is made in one piece with the fastening head;

the holding projection comprises a boss provided in the printing plate; and the fastening head delimits a free edge of the head, and the boss has a longitudinal shape which extends along the edge of the head of the printing plate.

In addition, the present invention provides a printing assembly for a rotary press, including an impression cylinder having a cylindrical outer surface and provided with a fitting channel which opens onto the outer surface, a printing plate disposed on the impression cylinder, and a holding device disposed in the fitting channel and suitable for holding the printing plate on the impression cylinder, wherein the printing plate is a printing plate as defined hereinbefore, and wherein the holding device includes a holding member suitable for holding the printing plate by mating with the holding projection.

According to other embodiments, the printing assembly may include one or more of the following characteristics:

the holding device includes a holding element having a first leaf spring which supports the holding member and is suitable for contacting the holding projection in order to hold the fastening head of the printing plate;

the first leaf spring includes a first free leaf end forming the holding member;

the holding element includes a second leaf spring suitable for contacting the fastening tail of the printing plate, and the first and the second leaf springs are made in one piece;

the first and second leaf springs include arms which, in a non-urged state, are coplanar; and the second leaf spring includes a second free leaf end and each of the first and second free leaf ends is bent in the same direction.

BRIEF DESCRIPTION OF DRAWINGS

A clearer understanding of the invention will be facilitated by the following description, given purely by way of example and with reference to the appended drawings, in which.

DESCRIPTION OF PREFERRED EMBODIMENTS

Figure 1:
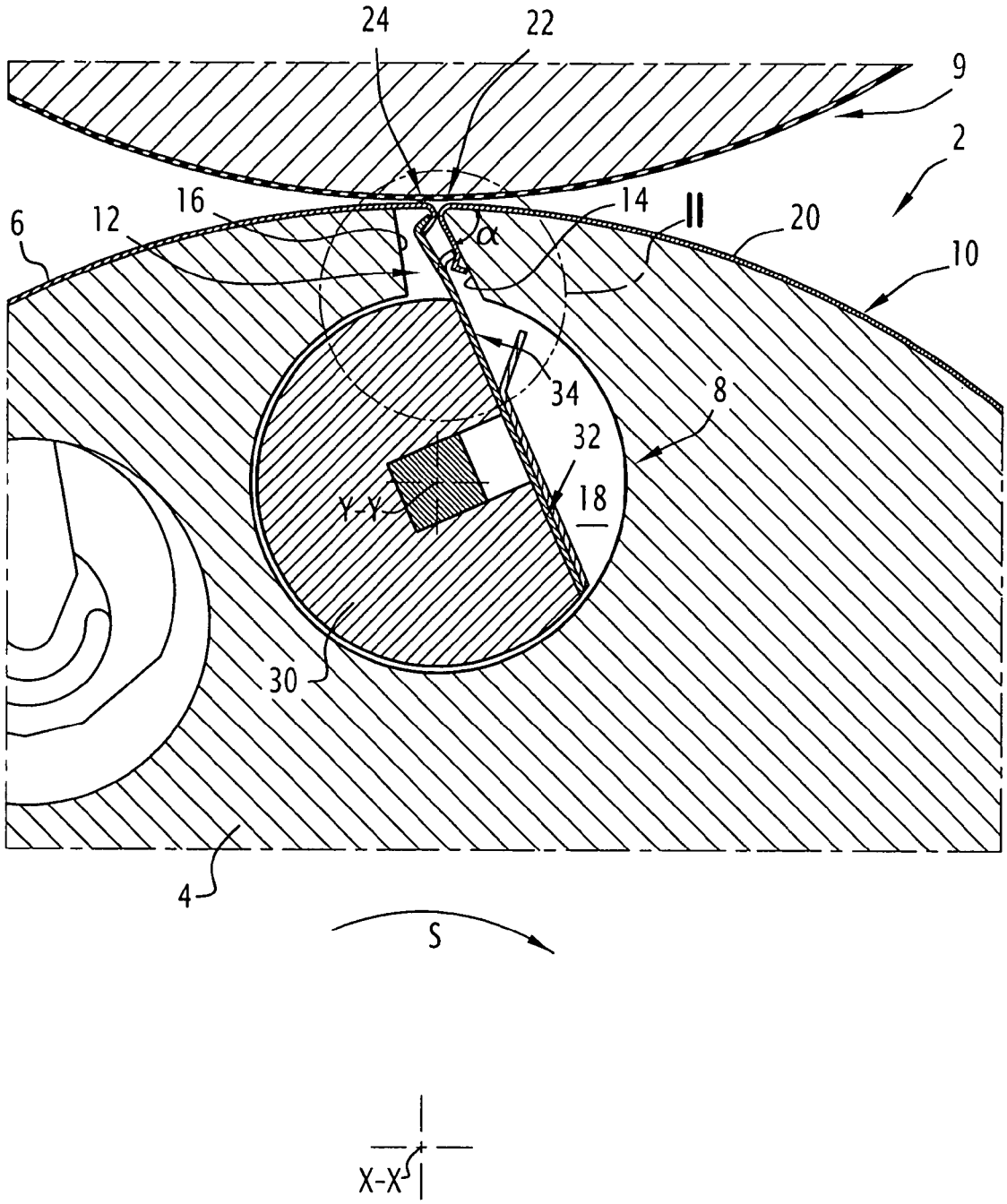
FIG. 1 is a cross-section of a printing assembly provided with a printing plate according to the invention.

FIG. 1 is a cross-section of a portion of a printing assembly of a rotary press, designated with the general reference numeral 2.

The printing assembly 2 comprises an impression cylinder 4, also known as a plate cylinder, a printing plate 6 and a device 8 for holding the plate 6 on the impression cylinder 4. In addition, the printing assembly 2 comprises a blanket cylinder 9.

Figure 2:
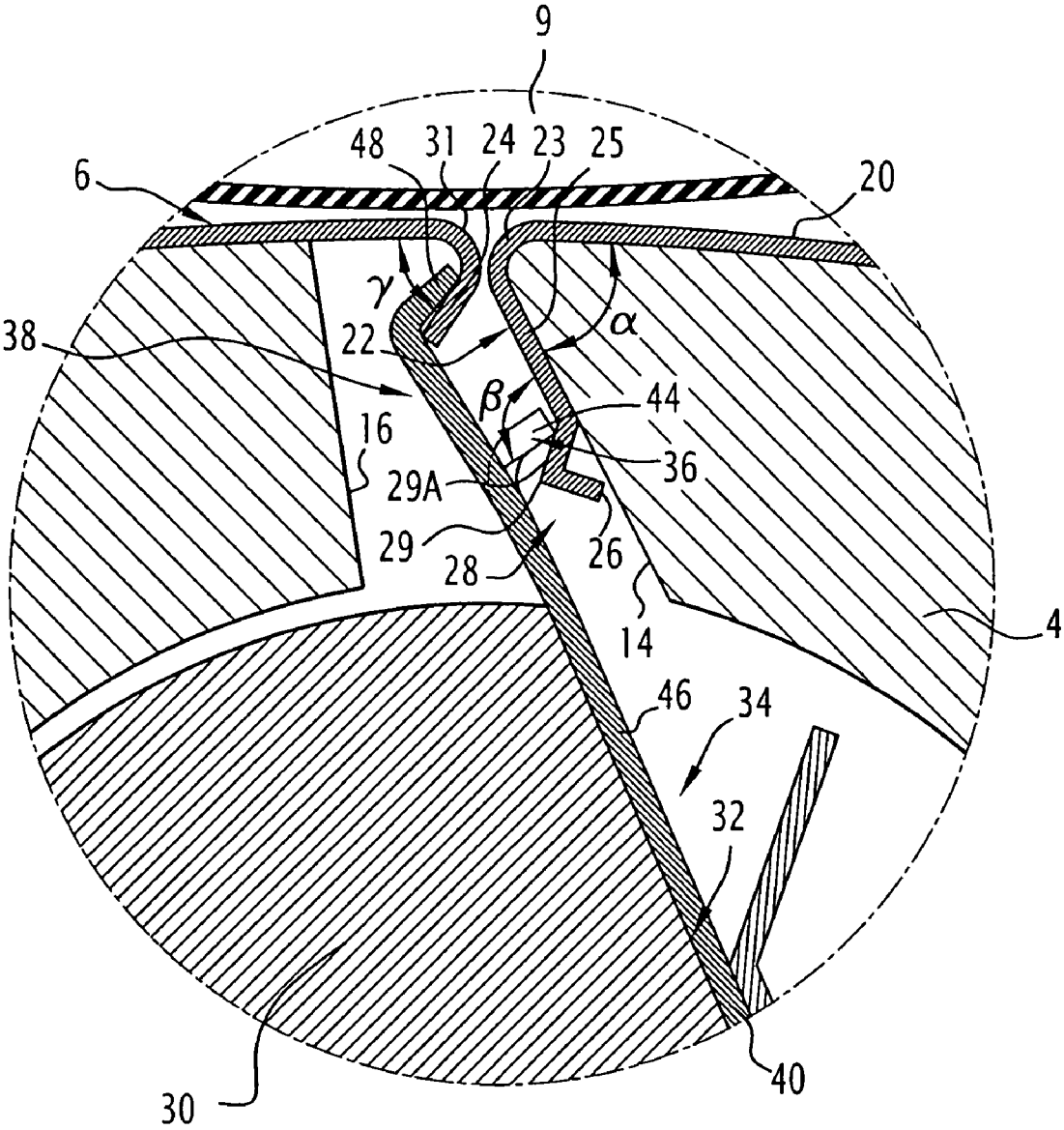
FIG. 2 is an enlarged view of detail II of FIG. 1.

During operation, the impression cylinder 4 is driven in rotation about its centre axis X-X in a direction S which is the clockwise direction in FIGS. 1 and 2.

In the following, the terms "radially", "axially" and "circumferentially" will be used in relation to the centre axis X-X.

The impression cylinder 4 defines a cylindrical outer surface with a circular cross-section 10. In addition, the impression cylinder 4 comprises a fitting channel 12 which opens onto the outer surface 10 and has a trapezoidal cross-section. The fitting channel 12 forms a front planar wall 14 and a rear planar wall 16 which extend facing one another. On the side remote from the outer surface 10, the fitting channel 12 widens to form a cylindrical recess with a circular cross-section 18.

The printing plate 6 is, for example, made of a thin metal sheet and comprises a common portion 20 which is provided with an image to be printed. At its ends the printing plate 6 has a fastening head 22 and a fastening tail 24.

The fastening head 22 has a flat central portion 25. Said central portion 25 is connected to the common portion 20 of the printing plate 6 by a bent portion 23 and forms an acute angle $\alpha$ with said common portion 20. The central portion 25 of the fastening head 22 rests flat against the front wall 14.

The fastening head 22 also delimits a free edge 26, which, when fitted, extends parallel to the centre axis X-X.

In addition, the fastening head 22 forms a holding projection 28. The holding projection 28 is connected on one side to the central portion 25 and to the free edge 26 on the other and thus forms a free end of the fastening head 22. In the present case, the holding projection 28 is made in one piece with the printing plate 6 and takes the form of a boss provided on said fastening head 22. The boss 28 has a longitudinal shape which extends along the edge of the head of the printing plate.

When shown in cross-section as in FIG. 2, the holding projection 28 is generally V-shaped. The tip 29 of the V points away from the front wall 14. In addition, the holding projection 28 comprises an inclined portion 29A which is defined by the radially exterior arm of the V and which is inclined by an obtuse angle β relative to the central portion 25 of the fastening head 22.

In a variation, the holding projection 28 may have a C-shaped or U-shaped cross-section.

The fastening tail 24 is formed by a bent portion 31 of the printing plate 6 which forms an acute angle γ with the common portion 20.

When fitted, the holding projection 28 is disposed radially internally relative to the fastening tail 24.

The holding device 8 comprises a clamping bar 30 disposed in the recess 18 so as to be displaceable about an axis of rotation Y-Y. The clamping bar 30 is provided with a flat portion 32 on which a holding element 34 is fixed. The holding element 34 is made in one piece of metal sheet, preferably spring steel.

The holding element 34 is provided with a first leaf spring 36 and a second leaf spring 38, the two leaf springs 36, 38 being connected by a base element 40.

Figure 3:
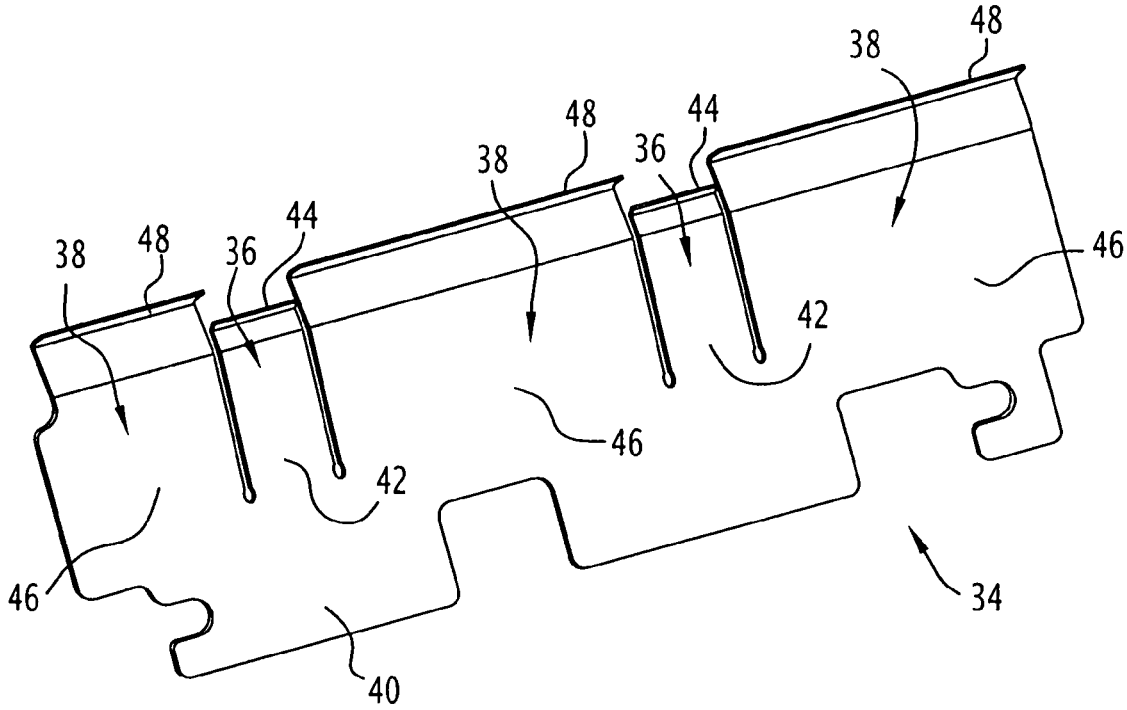
FIG. 3 is a perspective view of a holding element according to the invention.

As shown in FIG. 3, a plurality of first leaf springs 36 and a plurality of second leaf springs 38 may be fixed to the base element 40. The example shown comprises two first leaf springs 36 and three second leaf springs 38.

The first leaf spring 36 consists of a first leaf arm 42 and a first free leaf end 44.

The second leaf spring 38 consists of a second leaf arm 46 and a second free leaf end 48.

The leaf arms 42, 46 are bent in the same direction, which simplifies the holding element 34 to be formed by folding.

The first leaf end 44 is radially set back in relation to the second free leaf end 46. Furthermore, the first free leaf end 44 is bent relative to the first leaf arm 42. The second free leaf end 48 is bent relative to the second leaf arm 46. The first 44 and second 48 free leaf ends are bent in the same direction relative to their associated leaf arm. As can be seen in FIG. 3, the leaf arms 46, 48 of the leaf springs 36, 38 are coplanar in the non-urged state of the holding element 24.

The first free end 44 is suitable for contacting the holding projection 28, specifically the inclined portion 30, in order to hold the fastening head 22 in the fitting channel 12.

By shape-mating, the first free leaf end 44 and the holding projection 28 prevent the fastening head 22 from being drawn out radially towards the exterior during operation of the printing press.

In addition, the wall thickness of the holding element 34 is identical over its entire area such that fewer deforming operations are required.

The printing assembly 2 according to the invention operates in the following manner.

Proceeding from the situation in which the printing plate 6 is disposed on the impression cylinder 4, and where the fastening head 22 and the fastening tail 24 extend into the holding channel 16. The holding element 34 is not in contact with the printing plate 6 and is in a tilted position in the anticlockwise direction in relation to that of FIGS. 1 and 2.

In order to fix the printing plate 6 disposed on the impression cylinder 4, the clamping bar 30 is rotated in a locking direction, which is clockwise in FIGS. 1 and 2. During this rotation, the free end 44 of the first leaf spring 36 comes into contact with the inclined portion 30 of the boss 28, and creates a reaction force which pulls the fastening head 22 radially towards the interior.

At the same time, the free end 48 of the second leaf spring 38 engages behind the fastening tail 24 by shape-mating and pulls the fastening tail 24 circumferentially towards the fastening head 22.

The contact between the first free end 44 and the inclined portion 30 allows the fastening head 22 to be held securely without play. Consequently, the impression cylinder 4 may be driven at very high rotational speeds reaching, for example, 60,000 revolutions per hour.

In addition, forming the holding projection 28 in one piece with the printing plate 6 ensures that manufacturing costs are kept low.

The invention claimed is:

1. A printing assembly for a rotary press comprising:

an impression cylinder having a cylindrical outer surface and a fitting channel which opens onto the outer surface, a printing plate disposed on the impression cylinder, and a holding device disposed in the fitting channel suitable for holding the printing plate on the impression cylinder, the holding device including a holding element that includes a first leaf spring and a second leaf spring, the first leaf spring including a holding member, wherein the printing plate includes a fastening head for fastening to the impression cylinder, and a fastening tail for fastening to the impression cylinder, wherein the fastening head comprises a holding projection for mating with the holding member, the holding member being suitable for contacting the holding projection in order to hold the fastening head of the printing plate, wherein the second leaf spring is suitable for contacting the fastening tail of the printing plate, wherein the first leaf spring and the second leaf spring comprise arms which, in a non-urged state, are coplanar.

2. The printing assembly recited in claim 1, wherein the holding projection is made in one piece with the fastening head.

3. The printing assembly recited in claim 2, wherein the holding projection comprises a boss provided in the printing plate.

4. The printing assembly recited in claim 3, wherein the fastening head delimits a free edge of the fastening head, and wherein the boss has a longitudinal shape which extends along the free edge of the fastening head of the printing plate.

5. The printing assembly recited in claim 1, wherein the first leaf spring comprises a first free leaf end forming the holding member.

6. The printing assembly recited in claim 5, wherein the second leaf spring comprises a second free leaf end, and wherein the first free leaf end and the second free leaf end are bent in the same direction.

7. The printing assembly recited in claim 1, wherein the first leaf spring and the second leaf spring are made in one piece.

8. The printing assembly recited in claim 1 wherein the impression cylinder includes a center axis, the arm of the first leaf spring and the arm of the second leaf spring, in a non-urged state, both extending away from the impression cylinder in a plane that runs parallel to a plane that passes through the center axis.

9. A printing assembly for a rotary press comprising:

an impression cylinder having a cylindrical outer surface and a fitting channel which opens onto the outer surface;

a printing plate disposed on the impression cylinder, the printing plate having a fastening head at a first end thereof and a fastening tail at a second end thereof, opposite from the first end; and a holding device disposed in the fitting channel for holding the printing plate on the impression cylinder comprising a clamping bar having a flat surface, and a holding element formed from a single metal sheet connected to the flat surface and including a first holding member for holding the printing plate at the fastening head and a second holding member holding the printing plate at the fastening tail;

wherein the first holding member comprises a first leaf spring and the second holding member comprises a second leaf spring;

wherein the first leaf spring has a first leaf spring arm and the second leaf spring has a second leaf spring arm, the first and second leaf spring arms being coplanar in a non-urged state of the holding device.

10. The printing assembly recited in claim 9, wherein the fastening head has a holding projection and the first holding member holds the printing plate at the fastening head by mating with the holding projection.

11. The printing assembly recited in claim 9 wherein the impression cylinder includes a center axis, the clamping bar adapted to rotate about an axis parallel to the center axis to generate an urged state and a non-urged state.

12. A printing assembly for a rotary press comprising:

an impression cylinder having a cylindrical outer surface and a fitting channel which opens onto the outer surface;

a printing plate disposed on the impression cylinder comprising a fastening head and a fastening tail; and a holding device disposed in the fitting channel for holding the printing plate on the impression cylinder comprising a clamping bar having a flat surface, and a holding element formed from a single metal sheet connected to the flat surface, the holding element having a first side adapted to be connected to the flat surface and a second side, a first leaf spring formed on the second side adapted to hold the printing plate at the fastening head and a second leaf spring formed on the second side adapted to hold the printing plate at the fastening tail;

wherein the impression cylinder includes a center axis, the clamping bar being adapted to rotate about an axis parallel to the center axis to generate an urged state and a non-urged state, the first leaf spring has a first leaf spring arm and the second leaf spring has a second leaf spring arm, the first and second leaf arms, in the non-urged state, being coplanar.

13. The printing assembly recited in claim 12, wherein the fastening head has a holding projection and the first leaf spring holds the printing plate at the fastening head by mating with the holding projection.

* * * * *